US005687795A

United States Patent [19]

Patel et al.

[11] Patent Number: 5,687,795

[45] Date of Patent: Nov. 18, 1997

[54] PACKER LOCKING APPARATUS INCLUDING A TIME DELAY APPARATUS FOR LOCKING A PACKER AGAINST PREMATURE SETTING WHEN ENTERING A LINER IN A WELLBORE

[75] Inventors: Dinesh R. Patel, Sugar Land; Ervin Randermann, Jr., Beasley, both of Tex.

[73] Assignee: Schlumberger Technology Corporation, Houston, Tex.

[21] Appl. No.: 572,523

[22] Filed: Dec. 14, 1995

[51] Int. Cl.[6] ..... E21B 23/00

[52] U.S. Cl. ..... 166/387; 166/120

[58] Field of Search ..... 166/387, 118, 166/119, 120

[56] References Cited

U.S. PATENT DOCUMENTS 4,989,672 2/1991 Burns, Sr. et al. .

5,058,673 10/1991 Muller et al. .

5,146,983 9/1992 Hromas et al. ..... 166/120 X 5,320,183 6/1994 Muller et al. .

*Primary Examiner*—William P. Neuder

*Attorney, Agent, or Firm*—Gordon G. Waggett; John H. Bouchard; John J. Ryberg

[57] ABSTRACT

A packer assembly adapted to be disposed in a wellbore includes a packer and a packer lock apparatus, the packer lock apparatus including a lock and release apparatus for locking the packer in an unset condition, releasing the lock on the packer which locks the packer in the unset condition when the packer is lowered into a smaller diameter casing in the wellbore, allowing the packer to begin changing from the unset condition to a set condition, and a time delay apparatus for requiring a predetermined time period to elapse, following the release by the lock and release apparatus of the lock on the packer, before the packer can be fully changed from the unset condition to the set condition. As a result, the entire packer will be disposed within the smaller diameter casing before the packer is fully set.

8 Claims, 5 Drawing Sheets

PACKER LOCKING APPARATUS INCLUDING A TIME DELAY APPARATUS FOR LOCKING A PACKER AGAINST PREMATURE SETTING WHEN ENTERING A LINER IN A WELLBORE

BACKGROUND OF THE INVENTION

The subject matter of the present invention relates to a packer locking apparatus adapted to be disposed in a wellbore including a time delay apparatus for locking a packer assembly and preventing the packer from prematurely setting prior to a time when the packer assembly begins to enter a liner or casing in the wellbore, the lock on the packer being released when the packer assembly begins to enter the liner, the time delay apparatus allowing a predetermined time period to elapse after the packer assembly begins to enter the liner and the lock on the packer is released thereby preventing premature setting of the packer and preventing damage to the seal elements. The time delay provides enough time for the entire packer to enter the liner in the wellbore before the packer is unlocked. As a result, damage to the packer seal element is averted. The packer can then be set, at the desired depth, by longitudinal motion of the setting mandrel.

When a packer assembly, which includes a packer, is initially lowered into a wellbore, the packer of the packer assembly may be initially lowered into a larger diameter liner or casing in the wellbore. Eventually, the packer may subsequently be lowered from the larger diameter liner or casing into a smaller diameter liner or casing in the wellbore. When the packer is being lowered into the wellbore from the larger diameter liner and into the smaller diameter liner, it is necessary that the packer be disposed in other than a setting position until such time that the entire packer is completely disposed within the smaller diameter liner. When the entire packer is completely disposed within the smaller diameter liner or casing, only then can it set.

As a result, a lock apparatus is needed in conjunction with the packer assembly to prevent a premature setting of the packer when the packer assembly is being lowered from the larger diameter liner into the smaller diameter liner in the wellbore, otherwise the packer may be prematurely set and may be damaged during its entry into the smaller diameter liner. The lock apparatus should ensure that the packer is disposed in other than a setting position following a time when the packer assembly is initially lowered from the larger diameter liner and into the smaller diameter liner and prior to a time when the entire packer of the packer assembly is completely disposed within the smaller diameter liner or casing in the wellbore As a result, the lock apparatus will ensure that the entire packer of the packer assembly is completely disposed within the smaller diameter liner.

U.S. Pat. No. 4,989,672 to Burns Sr. et al discloses a packer locking apparatus for locking a packer against premature actuation in a wellbore; however, there is no separate time delay apparatus in Burns which initiates following a release of the lock for ensuring that the entire packer is completely disposed within a smaller diameter liner prior to setting the packer. The purpose of the lock of the present invention is to prevent damage to the packer elastomer seal element when entering into a smaller diameter liner. However, in the U.S. Pat. No. 4,989,672 patent to Burns Sr. et al, the packer is unlocked before the seal elements enter the small diameter liner, and the resultant premature setting of the packer could damage the packer seal elements.

U.S. Pat. No. 5,320,183 to Muller et al also discloses a locking apparatus in combination with a packer setting apparatus for unlocking the packer setting apparatus and allowing a packer to set; however, the lock in the Muller '183 patent does not release when the packer assembly is lowered into a liner of a wellbore and it does not disclose a separate time delay apparatus which ensures the entire packer is completely disposed within a smaller diameter liner prior to setting the packer.

U.S. Pat. No. 5,058,673 to Muller et al discloses in FIG. 5 a time delay apparatus in association with a packer for allowing a predetermined time period to elapse and setting a packer during the time period. However, the Muller '673 patent fails to disclose a locking apparatus for locking the packer against premature setting prior to lowering the packer into a liner of a wellbore, releasing the lock when the packer enters the liner, and starting the lapsing of the time period when the lock is released.

SUMMARY OF THE INVENTION

Accordingly, it is a primary object of the present invention provide a packer assembly including a packer lock apparatus adapted to be lowered into a liner or casing in a wellbore for preventing a premature setting of a packer of the packer assembly when the packer is lowered into the liner in the wellbore, the lock apparatus ensuring that the packer is unset when the packer is initially lowered into the liner and that the packer can be set only when the entire packer is completely disposed within the liner.

It is a further object of the present invention provide a packer assembly including a packer lock apparatus adapted to be lowered into a liner in a wellbore for preventing a premature setting of a packer of the packer assembly when the packer is lowered into a liner in the wellbore, the lock apparatus including a lock and release apparatus for locking the packer in a lock condition prior to lowering the packer into the liner thereby ensuring that the packer can not be set when the packer is first lowered into the liner and releasing the lock on the packer when the packer is lowered into the liner, the lock apparatus further including a delay apparatus for allowing the packer to be set only when a delay period has elapsed thereby ensuring that the packer can be set only when the entire packer is completely disposed within the liner.

It is a further object of the present invention provide a packer assembly including a packer lock apparatus adapted to be lowered from a larger diameter liner into a smaller diameter liner in a wellbore for preventing a premature setting of a packer of the packer assembly when the packer is lowered into the smaller diameter liner in the wellbore, the lock apparatus locking the packer in an unset condition prior to lowering the packer from the larger diameter liner and into the smaller diamter liner, the lock apparatus releasing the lock of the packer from the unset condition and allowing the packer to change from a lock condition to an unlocked condition only after the packer is initially lowered from the larger diameter liner and into the smaller diameter liner thereby ensuring that the packer is locked in the unset condition prior to a time when the packer is initially lowered into the smaller diameter liner, the lock apparatus including a time delay apparatus for producing a predetermined time delay and allowing the packer to be fully changed from the unset condition to a completely set condition only after the predetermined time period has elapsed following the release by the lock apparatus of the packer from the unset condition thereby further ensuring that the packer can set only when the entire packer is completely disposed within the smaller diameter liner.

These and other objects of the present invention are accomplished by designing and providing a packer assembly including a packer and a packer lock apparatus adapted to be disposed in a wellbore, where the packer lock apparatus includes a lock and release apparatus for locking the packer in an unset condition, releasing the lock on the packer which locks the packer in the unset condition when the packer is lowered into a smaller diameter casing in the wellbore, and allowing the packer to begin changing from the unset condition to a "can be set" condition, and a time delay apparatus for requiring a predetermined time period to elapse, following the release by the lock and release apparatus of the lock on the packer, before the packer can be fully changed from the unset condition to the "can be set" condition when the packer is disposed at the desired depth.

Recall that the packer assembly and associated packer disposed in the unset condition is initially lowered into a larger diameter casing in the wellbore. Further down within the wellbore, the larger diameter casing changes at an interface to a smaller diameter casing. The interface looks like an abrupt step where the larger diameter casing changes to the smaller diameter liner. At some point, the packer initially disposed in the larger diameter casing must be lowered into the smaller diameter casing. However, the packer must remain in the unset condition until such time that the entire packer is disposed within the smaller diameter casing. When the packer is disposed within the smaller diameter casing, the packer can then be set. If the packer begins to set prior to entering the smaller diameter casing, the packer seal element can be damaged. Therefore, the packer assembly includes a lock apparatus for locking the packer in an unset condition and preventing the packer from prematurely selling prior to its entry into the smaller diameter casing. The lock apparatus includes at least one pair (six in the actual embodiment of spring biased lock blocks which are adapted to be biased inwardly when the packer assembly begins to move from the larger diameter casing to the smaller diameter casing. Prior to its entry into the smaller diameter casing, the lock blocks are biased outwardly. As a result, at this point in time, the packer cannot change from the unset condition to the set condition. Therefore, the packer cannot be prematurely set prior to its entry into the smaller diameter casing. However, when the packer assembly begins to move from the larger diameter casing to the smaller diameter casing, the lock blocks are biased inwardly against the biasing force of a spring. When the lock blocks are biased inwardly, the lock imposed by the lock apparatus on the packer in the unset condition is removed and the packer can change from the unset condition to the set condition. Therefore, the packer assembly further includes a release apparatus for releasing the lock on the packer which locks the packer in the unset condition and allowing the packer to change from the unset condition to the set condition. However, now that the lock imposed by the lock apparatus on the packer is removed and the packer assembly is moving downwardly in the wellbore from the larger diameter casing to the smaller diameter casing and the packer can change from the unset condition to the set condition, it is necessary to ensure that the entire packer of the packer assembly is disposed within the smaller diameter casing before the packer begins to change from the unset condition to the set condition. As a result, the lock apparatus further includes a time delay apparatus for waiting a predetermined time period before allowing the packer to change from the unset condition to the set condition. Therefore, during the downward movement of the packer from the larger diameter casing to the smaller diameter casing, this additional predetermined lime period will give the packer enough time to fully enter the smaller diameter liner before the packer can be set. The time delay apparatus includes an off chamber separated from an atmospheric chamber by an oil metering orifice. The predetermined time period elapses during the time period when the oil in the oil chamber moves through the oil metering orifice to the atmospheric chamber. During this time period, a lock housing is moving downwardly and is pushing the oil through the oil metering orifice; however, a shoulder on the lock housing abuts against a packer setting mandrel and this abutment prevents the packer setting mandrel from moving downwardly faster than the lock housing is moving downwardly. The packer setting mandrel is subjected to a right hand torque, is pulled upwardly, then, is pushed downwardly. When the packer setting mandrel is pushed downwardly, the packer setting mandrel abuts against the shoulder of the lock housing. In response, the lock housing pushes the oil through the oil metering orifice causing the aforementioned time period delay. During the movement of the packer setting mandrel downwardly with the lock housing over the aforementioned time period, a slip bowl approaches a pair of slips and, at the same time, the drag blocks move downwardly and drag against the smaller diameter casing. However, the aforementioned time period must elapse before the slip bowl can actually contact the pair of slips. The slip bowl contacts the slips after the time delay elapses. The slips begin to radially expand and grip the smaller diameter casing. When the slips grip the casing, the packer setting mandrel is pushed further downwardly causing the packer to radially expand, grip the smaller diameter casing, and change from the unset condition to the set condition.

Therefore, the aforementioned time period delay forces the packer to refrain from completely setting until the time period first elapses, and this delay allows the entire packer enough time to be completely disposed within the smaller diameter liner before the packer can be fully set.

Further scope of applicability of the present invention will become apparent from the detailed description presented hereinafter. It should be understood, however, that the detailed description and the specific examples, while representing a preferred embodiment of the present invention, are given by way of illustration only, since various changes and modifications within the spirit and scope of the invention will become obvious to one skilled in the art from a reading of the following detailed description.

BRIEF DESCRIPTION OF THE DRAWINGS

A full understanding of the present invention will be obtained from the detailed description of the preferred embodiment presented hereinbelow, and the accompanying drawings, which are given by way of illustration only and are not intended to be limitative of the present invention, and wherein.

DETAILED DESCRIPTION OF THE PREFERRED EMBODIMENT

Referring to FIGS. 1–5, the packer assembly in accordance with the present invention is illustrated.

Figure 1:
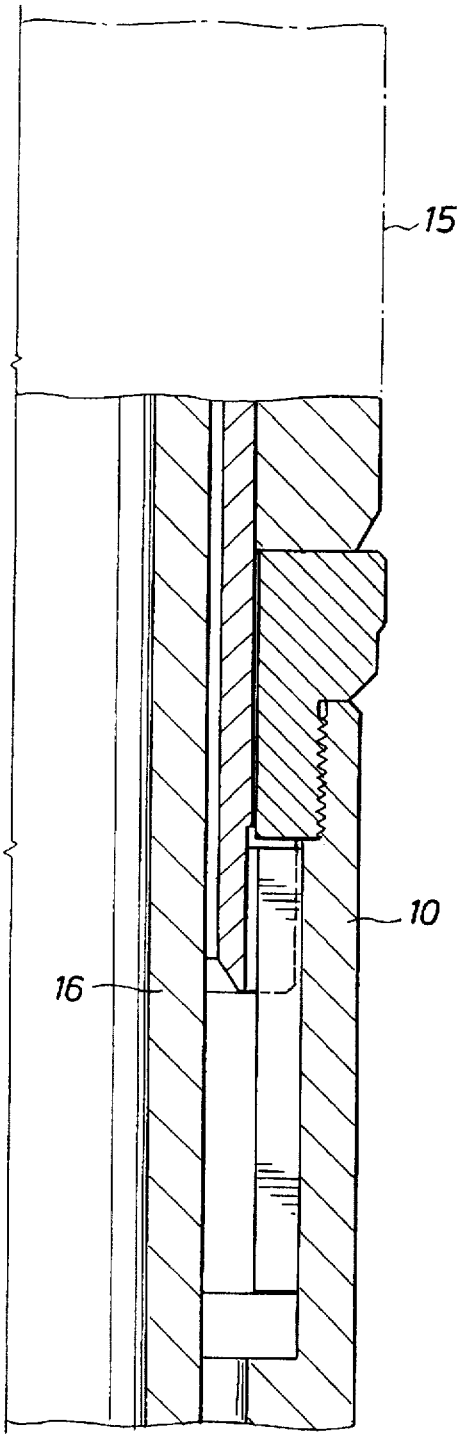
FIGS. 1 through 5 illustrate the packer assembly of the present invention before the packer assembly begins to enter the smaller diameter liner or casing, the packer assembly including the lock apparatus for locking the packer in the unset condition thereby preventing premature setting of the packer before the packer is lowered into the smaller diameter casing, the release apparatus for releasing the lock of the packer from the unset condition after the packer is lowered into the smaller diameter casing, and the time delay apparatus for allowing the packer to change from the unset condition to the set condition after the packer has been lowered into the smaller diameter casing only after a predetermined time period has elapsed.
Figure 2:
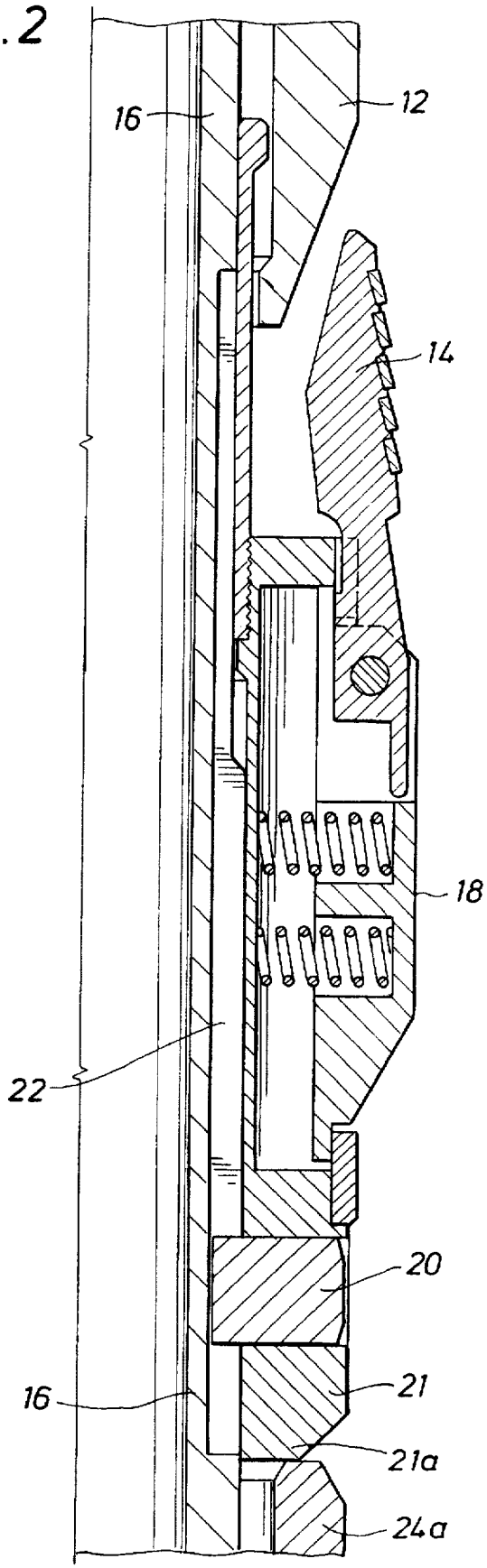
Figure 6:
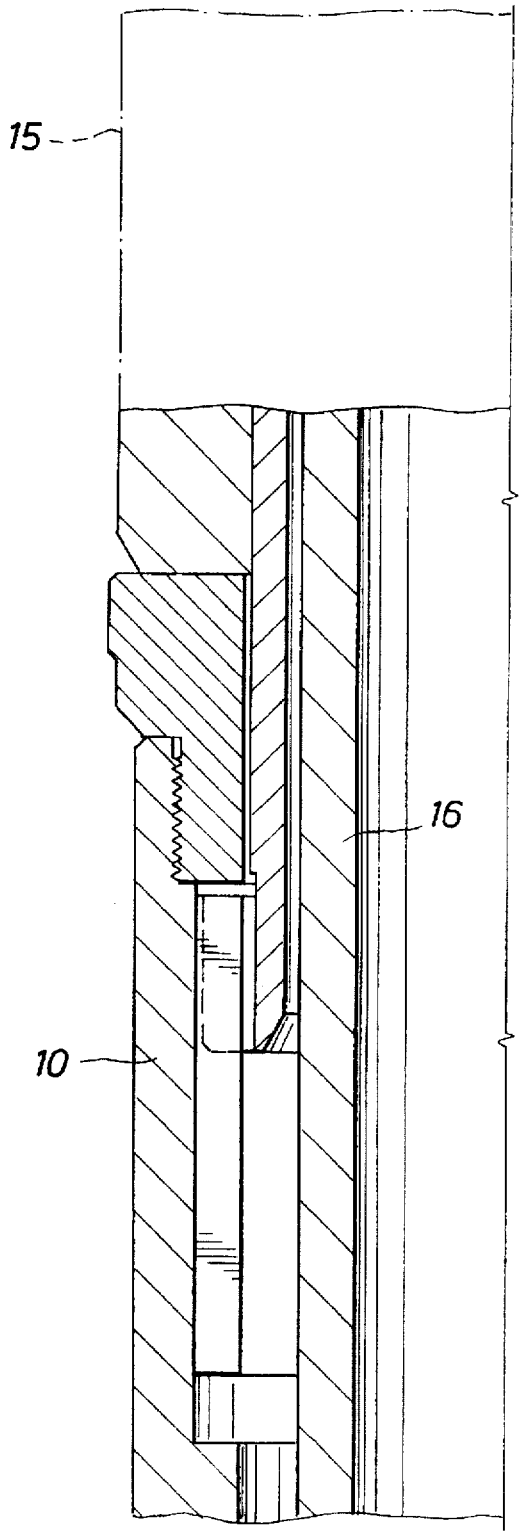
FIGS. 6–10 illustrate the packer assembly of the present invention after the packer assembly already entered the smaller diameter liner or casing.

In FIGS. 1 and 2, the packer assembly includes the following elements. A slip bowl housing 10 in FIG. 1 includes a slip bowl 12 in FIG. 2 along with a packer setting mandrel 16. At the end of the slip bowl housing 10 in FIG. 2, the slip bowl 12 is adapted to contact a slip 14 when the slip bowl 12 moves downwardly in FIG. 2 to meet the slip 14. When the slip bowl 12 meets the slip 14, the slip 14 expands radially outwardly in FIG. 2 to contact a liner or casing in a wellbore. When the slip 14 contacts the liner in the wellbore, further downward movement of the packer setting mandrel 16 will set a packer. In FIGS. 1 and 6, a packer 15 is connected above the slip bowl housing 10 in FIG. 1. For details regarding the location of the packer relative to the slip bowl housing 10 and slip bowl 12, see FIGS. 1 and 2 in U.S. Pat. No. 5,320,183 to Muller et al entitled "Locking Apparatus for Locking a Packer Setting Apparatus and Preventing the Packer from Setting Until a Predetermined Annulus Pressure is Produced", the disclosure of which is incorporated by reference into this specification.

Figure 11:
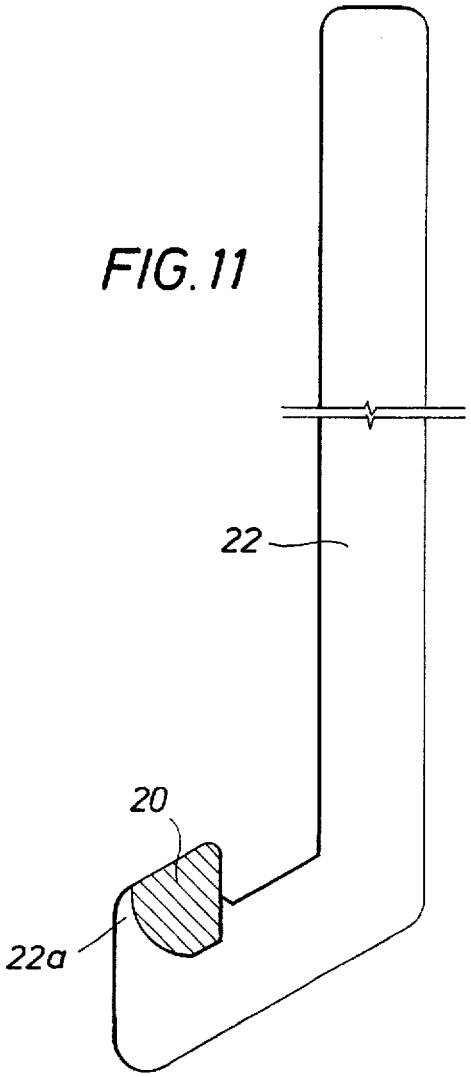
FIG. 11 illustrates an index lug in slot forming a part of the packer assembly of the present invention, the index lug in slot being used by the packer assembly to set the packer after the predetermined time period has already elapsed.

In FIGS. 2 and 11, the slip 14 is connected to a packer drag block 18. The drag block 18 functions to contact a liner or casing in a wellbore and "drag" along the surface of the liner. Since the drag block 18 drags along the surface of the liner or casing in a wellbore, the slip bowl 12 tends to move toward the slip 14 and, when the slip bowl 12 contacts the slip 14, the slip 14 will radially expand outwardly into gripping engagement with the liner or casing. An index lug 20 rides within a slot 22 disposed within the packer setting mandrel 16, the index lug 20 and slot 22 being shown again in FIG. 11 of the drawings. In FIG. 2, the top end **24*a* of a lock housing 24 is shown in contact with a lower end 21*a* of a housing 21 which encloses the index lug 20. As will be discussed later in this specification, the lock housing 24** forms a part of a time delay apparatus which in turn forms a part of a lock apparatus which in turn forms a part of the packer assembly in accordance with the present invention.

Figure 3:
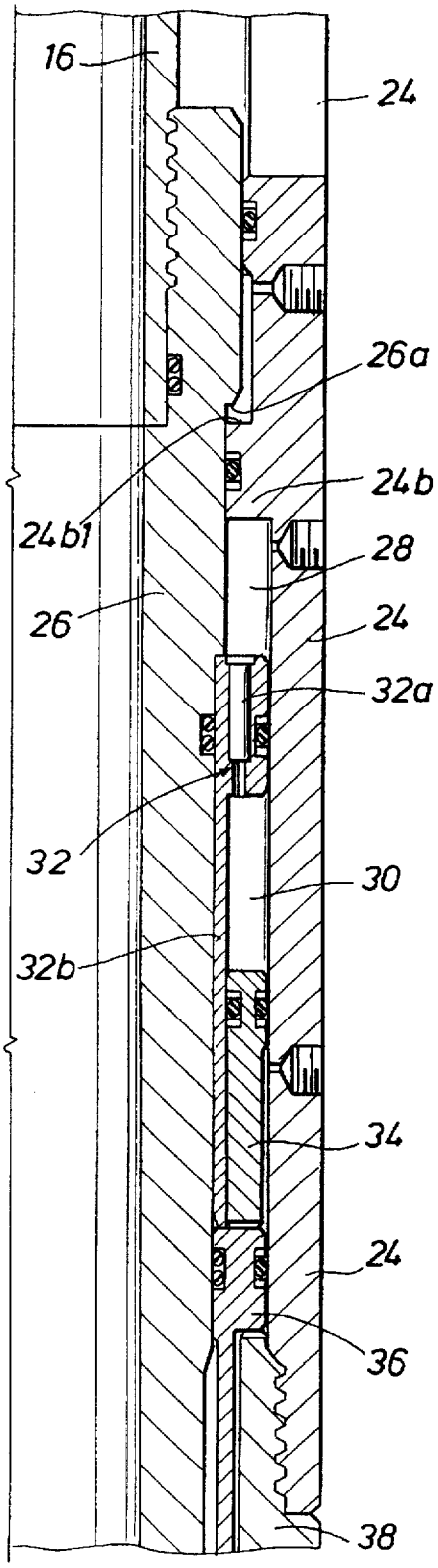

In FIG. 3, a mandrel 26 is threadedly connected to the packer setting mandrel 16, the mandrel 26 including a shoulder **26*a*. In addition, the lock housing 24 includes a traversely directed member 24*b* which further includes a shoulder 24*b*1. The shoulder 24*b*1 of the traversely directed member 24*b* of the lock housing 24 is adapted to abut against the shoulder 26*a* of the mandrel 26, this abutment being important for ensuring that the packer of the packer assembly cannot be fully set until such time that the aforementioned time delay produced by the aformentioned time delay apparatus has elapsed. This function will be described in more detail later in this specification. The lock housing in FIG. 3 defines two chambers: an oil chamber 28 and an atmospheric chamber 30. The oil chamber 28 is filled with oil. A time delay device 32, which includes an oil metering orifice 32*a*, separates the oil chamber 28 from the atmospheric chamber 30. A similar oil chamber and atmospheric chamber arrangement separated by an oil metering orifice can be seen in FIG. 5 of U.S. Pat. No. 5,058,673 to Muller et al, the disclosure of which is incorporated by reference into this specification. The oil chamber 28 is hounded by the transversely directed member 24*b*, the lock housing 24, the mandrel 26, and the lime delay device 32. The atmospheric chamber 30 is hounded by the time delay device 32, the lock housing 24, an extension 32*b* of the time delay device 32, and a first internal sub 34 which is disposed between the lock housing 24 on one side and the extension 32*b* and the mandrel 26 on the other side. A second internal sub 36 is sealingly disposed between the mandrel 26 and the lock housing 24, and is further disposed between the first internal sub 34 and extension 32*b* on one side and a stop sub 38 on the other side. The stop sub 38 is threadedly connected to the lock housing 24**.

Figure 4:
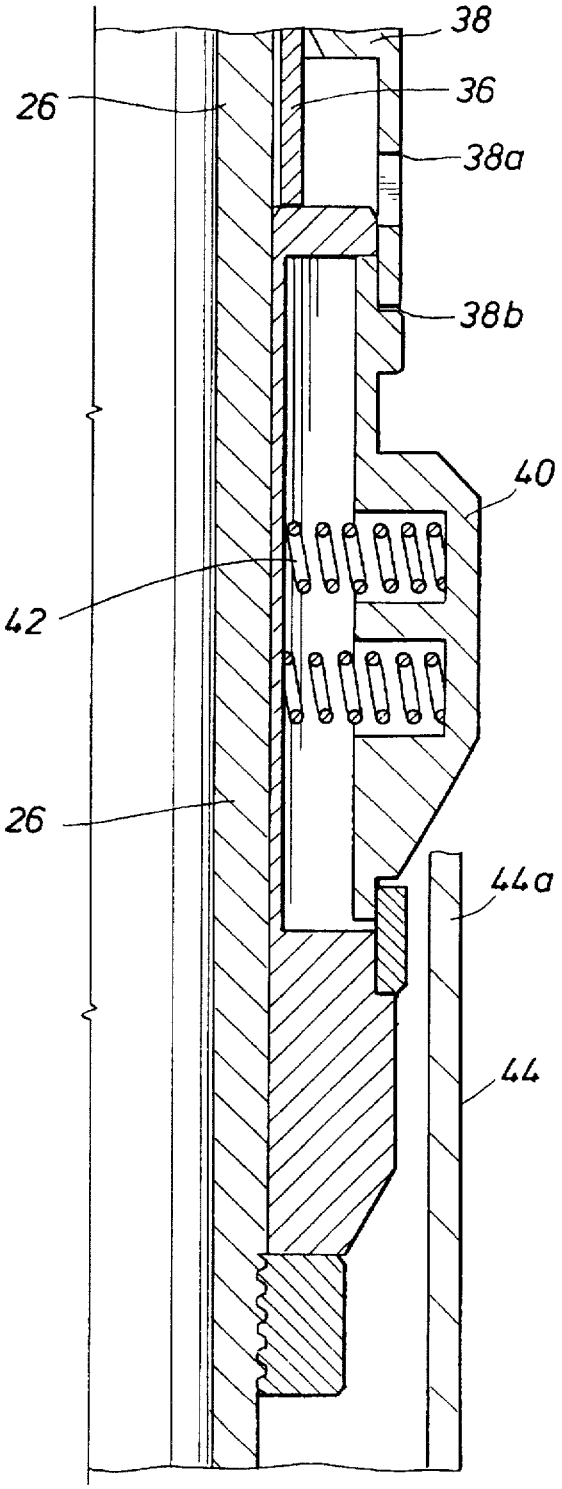
Figure 5:
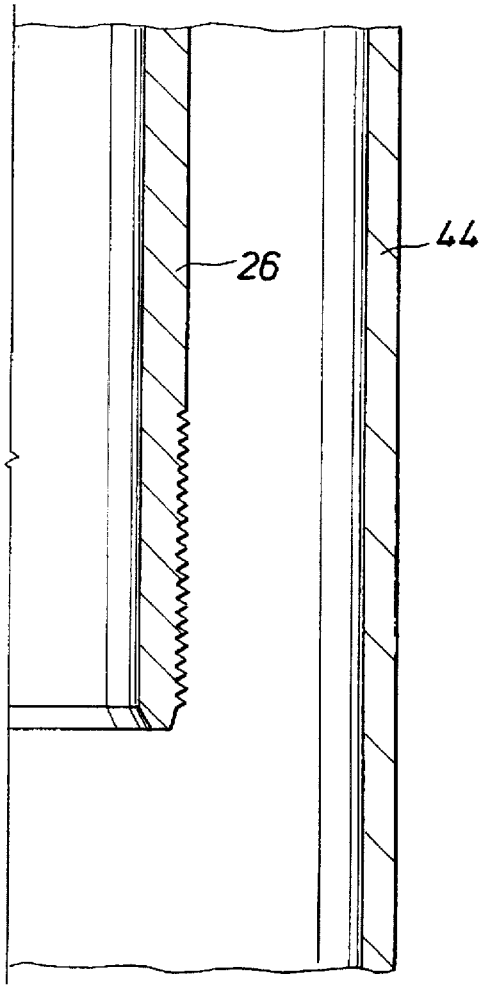
Figure 7:
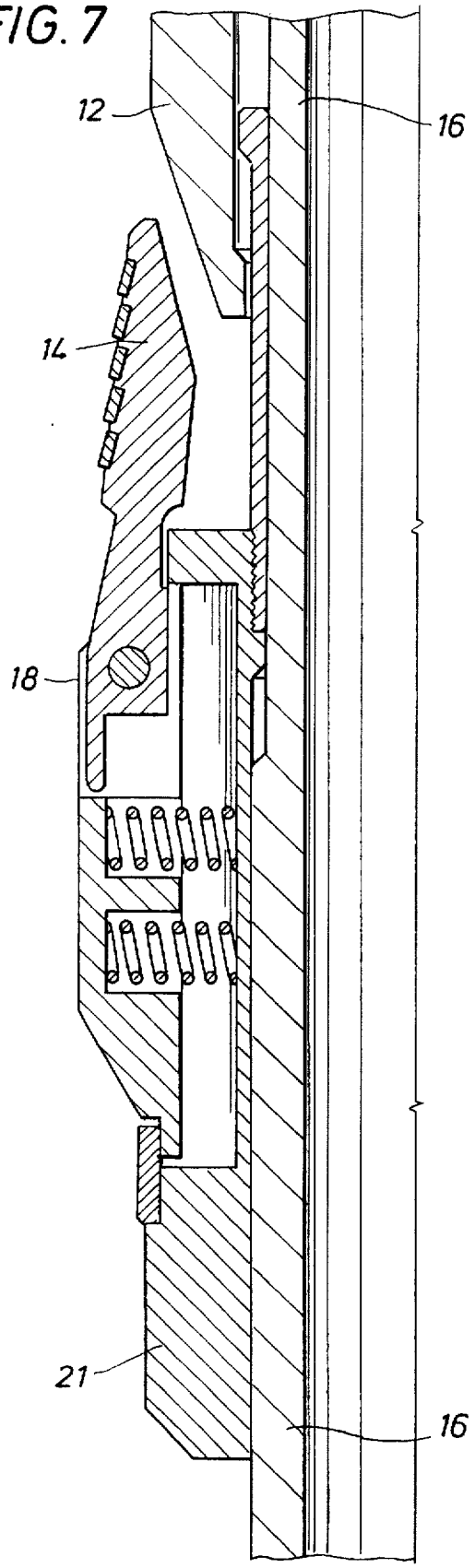
Figure 9:
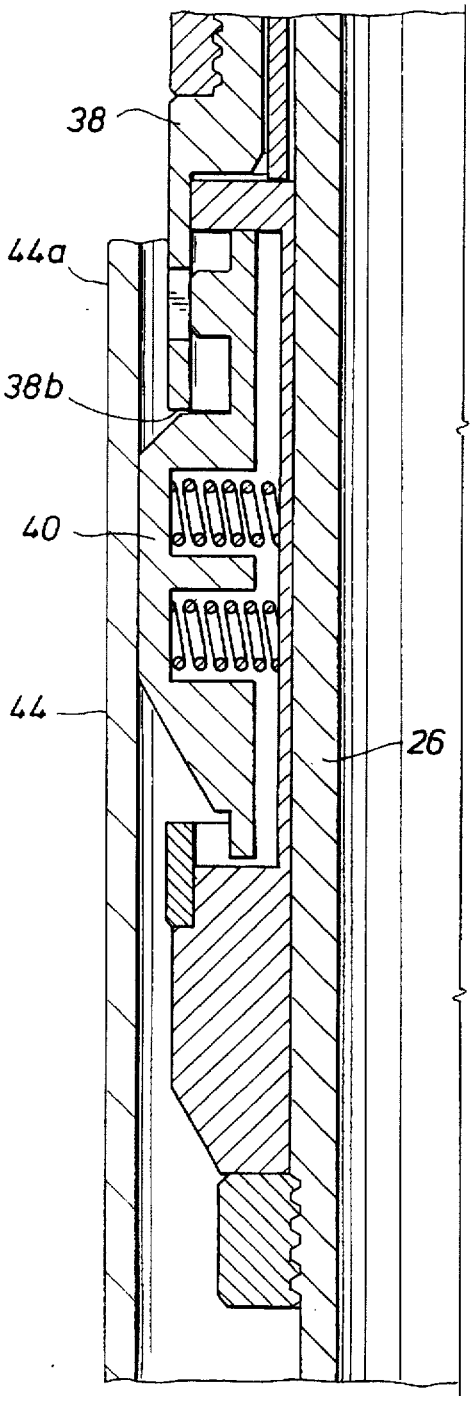
Figure 10:
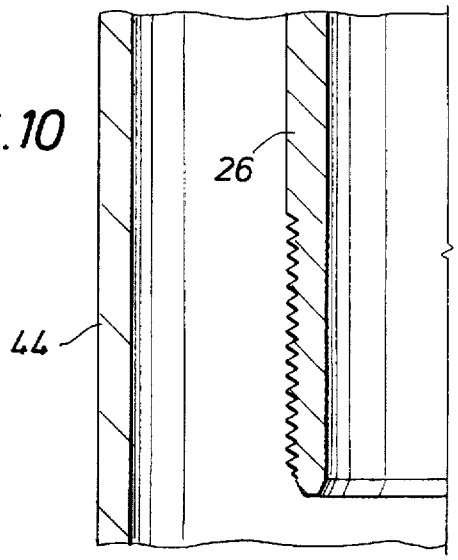

In FIGS. 4 and 5, beginning with FIG. 4, the stop sub 38 includes an extension **38*a*. An end 38*b* of the extension 38*a* of the stop sub 38 functions as a stop 38*b*. Noting that the stop 38*b* abuts against a spring biased lock block 40 when the lock block 40 is biased outwardly as shown in FIG. 4, and since the stop sub 38 is threadedly connected to the lock housing 24, any longitudinal movement of the lock housing 24 will transmit a corresponding longitudinal movement of the stop sub 38 and the stop 38*b*. However, since the stop 38*b* abuts against the lock block 40 when the lock block 40 is biased outwardly as shown in FIG. 4, the corresponding longitudinal movement of the stop 38*b* of FIG. 4 in response to the movement of the lock housing 24 in FIG. 3 will be halted by the outwardly biased lock block 40. Therefore, the lock block 40 functions like a lock and release apparatus; when the lock block 40 is outwardly biased as shown in FIG. 4, the stop 38*b* is prevented from moving downwardly in FIG. 4 (a lock apparatus), but when the lock block 40 is biased inwardly as shown in FIG. 9, the stop 38*b*** can move downwardly in FIG. 9 (a release apparatus). This function will be discussed in greater detail later in this specification.

In FIGS. 4 and 9, the lock block 40 of FIG. 4 is biased outwardly by a spring 42. As a result, the lock block 40 can move radially inwardly and radially outwardly in response to the biasing force of the spring 42. Recall that the packer assembly of the present invention is adapted to be lowered into a wellbore from within a larger diameter liner or casing in the wellbore and into a smaller diameter liner or casing in the wellbore. In FIG. 4, the lock block 40 is biased outwardly in the radially outward position, and it abuts against a top part **44*a* of the smaller diameter liner or casing 44 in the wellbore. When the lock block 40 in FIG. 4 is lowered into the smaller diameter liner 44, the lock block 40 begins to bias inwardly (see FIG. 9). When the lock block 40 is biased inwardly in response to the downward movement of the lock block 40 into the smaller diameter casing 44, the lock block 40 enters the smaller diameter casing 44 and, as a result, the stop 38*b*** is permitted to move downwardly as shown in FIG. 9. More on this function later in this specification.

A functional description of the operation of the present invention will be set forth in the following paragraphs with reference to FIGS. 1–5, 6–10, and 11 of the drawings.

Assume that the packer assembly of FIGS. 1–5 is lowered into a wellbore, and the wellbore is initially lined by a first larger diameter casing and is subsequently lined by a second smaller diameter casing, there being a step function like decrease in diameter at an interface between the larger diameter casing and the smaller diameter casing. The packer assembly of FIGS. 1–5 is disposed within the larger diameter casing and it is now necessary for the packer assembly to be lowered further into the wellbore from the larger diameter casing into the smaller diameter casing. The lock block 40 of FIG. 4 is touching the top end 44*a* of the smaller diameter casing 44 but the lock block 40 has not yet been lowered into the smaller diameter casing 44 and it is still disposed in its radially outward position, as shown in FIG. 4. At this point, the stop 38*b* of FIG. 4 cannot move downwardly in FIG. 4 because the stop 38*b* is prevented from moving downwardly by the radially outwardly disposed lock block 40 in FIG. 4. In FIG. 3, oil is still disposed within the oil chamber 28. However, since the stop 38*b* of FIG. 4 and the stop sub 38 of FIG. 3 cannot move downwardly in FIG. 4, the lock housing 24 cannot move downwardly in FIG. 3. Therefore, the oil in oil chamber 28 does not move through the oil metering orifice 32*a* to the atmospheric chamber 30.

Figure 8:
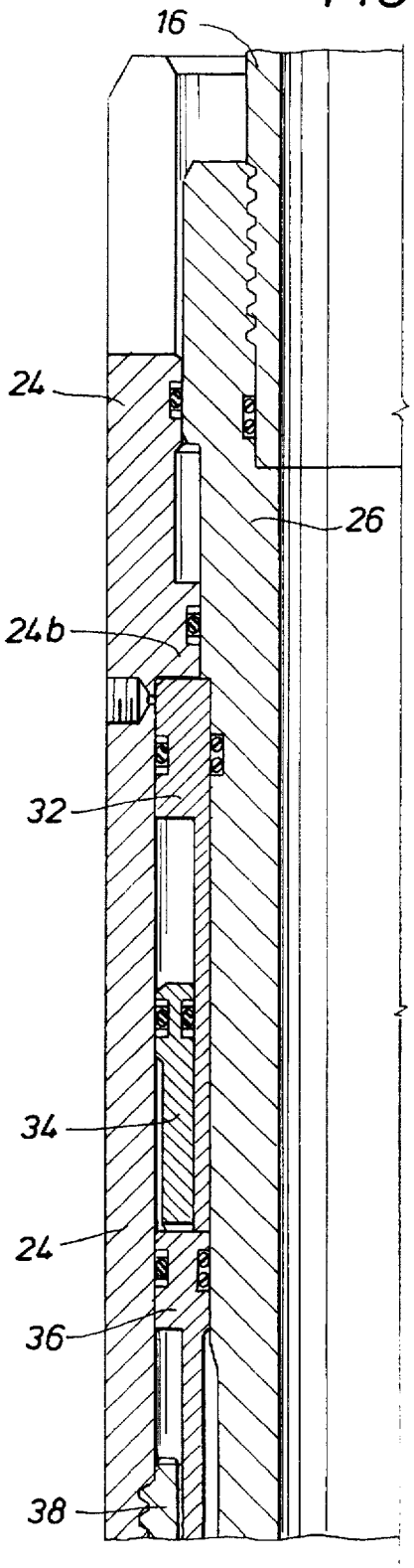

Assume now that the packer assembly of FIGS. 1–5 is lowered into the smaller diameter casing 44 of FIG. 4. Referring to FIG. 9, the lock block 40 is forced by the smaller diameter casing 44 to deflect radially inwardly against the biasing force of the spring 42. Eventually, the inner diameter of the smaller diameter casing 44 is equal to the outer diameter of the lock block 40; and, as the packer assembly is pushed downwardly into the wellbore, the lock block 40 of FIG. 4 moves down inside the top end 44*a* of the smaller diameter casing 44, as shown in FIG. 9. At this point, the stop 38*b* of FIG. 4 is no longer prevented from moving downwardly by the lock block 40. As a result, the stop 38*b* of FIG. 4 and the lock housing 24 of FIG. 3 begins to move downwardly in response to a hydrostatic pressure force of a wellbore fluid being applied to the top end 24*a* of the lock housing 24 in FIG. 2. Since the lock housing 24 is moving downwardly in FIG. 3 in response to the hydrostatic pressure force of the wellbore fluid in an annulus of the wellbore applied to top end 24*a*, the oil in oil chamber 28 begins to move through the oil metering orifice 32*a* of the time delay device 32 and into the atmospheric chamber 30. It takes a predetermined period of time for all of the off in the off chamber 28 of FIG. 3 to move through the oil metering orifice 32*a* and into the atmospheric chamber in response to the downward movement of the lock housing 24. Eventually, however, all of the oil in oil chamber 28 moves through the oil metering orifice 32*a* and into the atmospheric chamber 30 and the lock housing 24 has moved downwardly as shown in FIG. 8 until the transversely directed member 24*b* of the lock housing 24 touches the time delay device 32.

In the meantime, when the lock block 40 of FIG. 4 was deflected radially inwardly against the biasing force of the spring 42 as it entered the smaller diameter casing 44 and the lock housing 24 began to move downwardly in response to the hydrostatic pressure force of the wellbore fluid acting on the top end 24*a* of the lock housing 24, the operator at the wellbore surface applied a fight hand torque to the packer setting mandrel 16 in FIG. 2 and, at the same time, pulled up on the packer setting mandrel 16. This action by the operator moved the index lug 20 of FIG. 11 out of its position 22*a* in the slot 22, the position 22*a* being shown in FIG. 11. Now that the index lug 20 is no longer disposed in the position 22*a* of FIG. 11, the operator now pushes the packer setting mandrel 16 downwardly into the wellbore. The top end 24*a* of the lock housing of FIGS. 2–3 is moving downwardly in response to the wellbore fluid hydrostatic pressure, and the downward push on the packer setting mandrel 16 moves the drag blocks 18 into the smaller diameter casing 44 of FIG. 9. The drag blocks 18 drag against the inner surface of the smaller diameter casing 44, and, as a result, the slip bowl 12 tends to approach the slip 14 in FIG. 2. However, recalling that the packer setting mandrel 16 is threadedly connected to the mandrel 26 in FIG. 3, and the shoulder 26*a* of the mandrel 26 is disposed in abutment against the shoulder 24*b*1 of the transversely directed member 24*b* of the lock housing 24 in FIG. 3, the downwardly directed movement on the packer setting mandrel 16 and the downwardly directed movement of the mandrel 26, in response to the downward push on the packer setting mandrel 16 by the operator, is controlled by the downward movement of the lock housing 24. Recall again that the downward movement of the lock housing 24 is further controlled by the rate at which the oil in the oil chamber 28 is moving through the oil metering orifice 32*a* in FIG. 3 into the atmospheric chamber 30. Since it takes a predetermined period of time for the oil in oil chamber 28 to move through the orifice 32*a* into the atmospheric chamber 30, it must therefore take the same predetermined period of time for the packer setting mandrel 16 in FIGS. 2–3 to move downwardly. Since the rate at which the slip bowl 12 approaches the slip 14 of FIG. 2 is controlled by the rate of downward movement of the packer setting mandrel 16, it must therefore take the same predetermined period of time for the following events to happen: for the slip bowl 12 to approach the slip 14, contact the slip 14, cause the slip 14 to expand radially outwardly into gripping contact with the smaller diameter casing 44, and for the packer connected above the slip bowl housing 10 of FIG. 1 (packer not shown) to start to change from its unset condition to a fully set condition. Since the aforementioned predetermined period of time must elapse before the packer can change from an unset condition to a fully set condition, during the downward push by the operator on the packer setting mandrel 16 of FIG. 1, enough time has been allocated for the entire packer to be completely disposed within the smaller diameter casing 44 before the packer is completely changed from its unset condition to a fully set condition.

Therefore, although the packer was locked before being lowered into the smaller diameter casing 44, after the lock on the packer was released when the lock blocks 40 were deflected radially inwardly, the packer began to change from its unset condition to its fully set condition; however, it took a predetermined period of time for the packer to change from its unset condition to its fully set condition. This additional period of time gave the packer enough time to enter and be fully disposed within the smaller diameter casing 44 before the packer was fully set. As a result, the packer was not damaged.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. A packer assembly including a packer adapted to be disposed within a liner in a wellbore, comprising:

lock and release means for locking said packer in an unset condition before said packer is disposed within said liner in said wellbore, said lock and release means releasing the lock on said packer and allowing said packer to change from said unset condition to a fully set condition when said packer enters said liner in said wellbore, said lock and release means including lock block means for biasing in one direction and locking said packer in said unset condition before said packer enters said liner, said lock block means biasing in another opposite direction and releasing the lock on said packer in said unset condition and allowing said packer to change to said fully set condition after said packer enters said liner;

time delay means connected to said lock and release means for lapsing a predetermined period of time when said lock and release means releases said lock on said packer and allows said packer to change to said fully set condition; and means connected to said time delay means for changing said packer from said unset condition to said fully set condition when said time delay means lapses said predetermined period of time.

2. The packer assembly of claim 1, wherein said time delay means comprises a oil chamber, an atmospheric chamber, and an oil metering orifice interposed between said oil chamber and said atmospheric chamber, said oil metering orifice allowing the oil in said oil chamber to move slowly from said oil chamber to said atmospheric chamber after said lock block means biases in said another opposite direction and releases said lock on said packer, the means for changing said packer from said unset condition to said fully set condition changing said packer to said fully set condition when said oil in said oil chamber has moved to said atmospheric chamber.

3. A method of setting a packer in a liner of a wellbore, comprising the steps of:

locking said packer in an unset condition prior to lowering said packer into said liner of said wellbore, the locking step includes the steps of biasing a lock block in a first direction and preventing a lock housing from moving, preventing a packer setting mandrel from moving when the lock housing is prevented from moving, and locking said packer in said unset condition when the packer setting mandrel is prevented from moving;

releasing the lock on said packer and allowing said packer to change from said unset condition to a fully set condition when said packer is lowered into said liner of said wellbore;

lapsing a period of time after the lock on said packer is released; and changing said packer from said unset condition to said fully set condition when said period of time has elapsed.

4. The method of claim 3, wherein the releasing step comprises the steps of:

biasing said lock block in a second direction opposite to the first direction thereby releasing said lock housing and flowing said lock housing to move;

allowing said packer setting mandrel to move when the lock housing is allowed to move, the lock on said packer being released and said packer being allowed to change from said unset condition to a fully set condition when said packer setting mandrel is allowed to move.

5. The method of claim 4, wherein the lapsing step of lapsing a period of time after the lock on said packer is released comprises the steps of:

moving a fluid from a fluid chamber to an atmospheric chamber via a fluid metering orifice when the lock block is biased in said second direction and the lock housing is released allowing said lock housing to move; and lapsing said period of time during a time period when said fluid moves from said fluid chamber through said fluid metering orifice and into said atmospheric chamber.

6. An apparatus for setting a packer in a liner of a wellbore after said packer is lowered into said liner, comprising:

lock means for locking said packer in an unset condition prior to lowering said packer into said liner in said wellbore, said lock means releasing said lock on said packer when said packer is lowered into said liner in said wellbore, said lock means including lock block means biased initially in a first direction for biasing in a second direction opposite to said first direction when said packer is lowered into said liner of said wellbore, said lock on said packer being released when said lock block means is biased in said second direction;

time delay means responsive to the release of said lock on said packer by said lock means for lapsing a period of time following the release of said lock on said packer and during the lowering of said packer into said liner; and condition changing means responsive to the lapsing of said period of time by said time delay means for changing said packer from said unset condition to a set condition when said period of time has elapsed.

7. The apparatus of claim 6, wherein said time delay means comprises:

a fluid chamber, an atmospheric chamber, a fluid metering orifice interposed between the fluid chamber and the atmospheric chamber for allowing the fluid in said fluid chamber to move into said atmospheric chamber via said fluid metering orifice, and a lock housing adapted to move, said period of time lapsing and said lock housing moving during the lapse of said period of time when said fluid in said fluid chamber moves into said atmospheric chamber via said fluid metering orifice.

8. The apparatus of claim 7, wherein said condition changing means comprises a packer setting mandrel adapted to move, said packer setting mandrel moving during the lapse of said period of time, said packer changing from said unset condition to a set condition when said packer setting mandrel moves.

* * * * *